US009452366B2

(12) United States Patent
Schmid et al.

(10) Patent No.: US 9,452,366 B2
(45) **Date of Patent: *Sep. 27, 2016**

(54) TOY TRACK SET

(71) Applicant: Mattel, Inc., El Segundo, CA (US)

(72) Inventors: Paul W. Schmid, Ojai, CA (US); Stacy Lynn O'Connor, El Segundo, CA (US)

(73) Assignee: Mattel, Inc., El Segundo, CA (US)

( * ) Notice: Subject to any disclaimer, the term of this patent is extended or adjusted under 35 U.S.C. 154(b) by 78 days.

This patent is subject to a terminal disclaimer.

(21) Appl. No.: 13/871,019

(22) Filed: Apr. 26, 2013

(65) Prior Publication Data

US 2013/0288568 A1 Oct. 31, 2013

Related U.S. Application Data

(60) Provisional application No. 61/639,437, filed on Apr. 27, 2012.

(51) Int. Cl.
*A63H 18/00* (2006.01)
*A63H 18/06* (2006.01)

(52) U.S. Cl.
CPC ..... *A63H 18/00* (2013.01); *A63H 18/06* (2013.01)

(58) Field of Classification Search
CPC ..... A63H 18/00
USPC ..... 446/444
See application file for complete search history.

(56) References Cited

U.S. PATENT DOCUMENTS

| | | | |
|---|---|---|---|
| 469,948 | A | 3/1892 | Reed |
| 806,930 | A | 12/1905 | Smith |
| 812,595 | A | 2/1906 | Roberts |
| 831,907 | A | 9/1906 | Townsend |
| 889,169 | A | 6/1908 | Brothen |
| 1,113,945 | A | 10/1914 | Bain |
| 1,116,577 | A | 11/1914 | Dugger |
| 1,209,127 | A | 12/1916 | Corey |
| 1,244,457 | A | 10/1917 | Bain |
| 1,244,702 | A | 10/1917 | Christ |
| 1,247,226 | A | 11/1917 | Cole |
| 1,252,616 | A | 1/1918 | Reif |
| 1,261,691 | A | 4/1918 | Bunkley |
| 1,279,271 | A | 9/1918 | Cole |

(Continued)

FOREIGN PATENT DOCUMENTS

| | | | |
|---|---|---|---|
| CN | 201067632 | Y | 6/2008 |
| CN | 101687116 | A | 3/2010 |

(Continued)

OTHER PUBLICATIONS

European Search Report dated Nov. 13, 2013 for Application No. 13168331.0.

(Continued)

*Primary Examiner* — Michael Dennis
*Assistant Examiner* — Dolores Collins
(74) *Attorney, Agent, or Firm* — Kolisch Hartwell, P.C.

(57) ABSTRACT

A track set is provided. The track set includes a first track segment and a carriage. The first track segment has a first pivot and is rotatable about the first pivot from a first position to a second position. The carriage is rotationally coupled to an end of the first track segment by a second pivot. The carriage is configured to rotate about the second pivot as the first track segment rotates from the first position to the second position.

20 Claims, 10 Drawing Sheets

(56) References Cited

U.S. PATENT DOCUMENTS 1,284,477 A 11/1918 Seils
1,287,450 A 12/1918 Sabina et al.
1,287,608 A 12/1918 Austin
1,295,504 A 2/1919 Howard et al.
1,301,552 A 4/1919 Gaines
1,314,238 A 8/1919 Bain
1,315,108 A 9/1919 Gaines
1,317,184 A 9/1919 Voss
RE14,902 E 6/1920 Gaines
1,347,968 A 7/1920 O'Doie
1,351,981 A 9/1920 Zipf
1,355,636 A 10/1920 Bain
1,361,449 A 12/1920 Danner
1,392,727 A 10/1921 Welsh
1,454,173 A 5/1923 Keiner
1,472,783 A 11/1923 Bauer
1,478,350 A 12/1923 Okel
RE15,900 E 8/1924 Hetzner
1,523,244 A 1/1925 Bain
1,527,006 A 2/1925 O'Reilly
1,546,377 A 7/1925 Gunderman
1,560,181 A * 11/1925 Marx
1,561,633 A 11/1925 Bain
1,568,492 A 1/1926 Zabel
1,599,699 A 9/1926 Zabel
1,599,982 A 9/1926 Bauer
1,617,846 A 2/1927 Hawk
RE16,791 E 11/1927 Hawk
1,666,417 A 4/1928 Harris
1,696,532 A 12/1928 Enloe
RE17,312 E 6/1929 Beck
1,715,891 A 6/1929 Beck
1,724,447 A 8/1929 Abbott et al.
1,725,536 A 8/1929 Marx
1,739,719 A 12/1929 Gunderman
1,748,184 A 2/1930 Nichols
1,758,061 A 5/1930 Rentz et al.
1,870,586 A 8/1932 Platakis
1,872,204 A 8/1932 Wily
2,128,863 A 8/1938 Turrian
2,211,220 A 8/1940 Verplanck
2,249,728 A 7/1941 Cross
2,336,773 A 12/1943 Black et al.
2,391,529 A 12/1945 Walker
2,392,722 A 1/1946 Burlin
2,400,013 A 5/1946 Lowell et al.
2,400,410 A 5/1946 Hatcher
2,419,990 A 5/1947 Dishmaker
2,434,571 A 1/1948 Long
2,531,564 A 11/1950 Garbe
2,616,699 A 11/1952 Franks
2,634,128 A 4/1953 Reed
2,655,116 A 10/1953 Gowland
2,672,709 A 3/1954 Ernst
2,756,687 A 7/1956 Fields
2,785,504 A 3/1957 Kooistra, Sr.
2,838,159 A 6/1958 Siegfried
2,853,301 A 9/1958 Glass
2,998,673 A 9/1961 Rhodes
2,999,689 A 9/1961 Litwinczuk
3,251,155 A 5/1966 Bjork
3,298,692 A 1/1967 Glass et al.
3,300,891 A 1/1967 Glass et al.
3,314,169 A 4/1967 Wold
3,343,793 A 9/1967 Waser
3,401,484 A 9/1968 Anslover
3,542,366 A 11/1970 Schocker
3,548,534 A * 12/1970 Ryan ..... 446/430
3,570,171 A 3/1971 Shook
3,572,713 A 3/1971 Krause
3,600,849 A 8/1971 Faller
3,621,602 A 11/1971 Barcus et al.
3,633,308 A 1/1972 Yang
3,666,264 A 5/1972 Bartlett
3,703,989 A 11/1972 Tomiyama
3,708,116 A 1/1973 Woodward
3,712,538 A 1/1973 Starr et al.
3,726,476 A 4/1973 Porter et al.
3,734,404 A 5/1973 Baynes et al.
3,735,923 A 5/1973 Brigham et al.
3,795,983 A 3/1974 Gallagher et al.
3,803,756 A * 4/1974 Strongin ..... 446/429
3,818,628 A 6/1974 Ensmann et al.
3,860,238 A 1/1975 Kojima
3,908,303 A 9/1975 McKay et al.
3,986,296 A * 10/1976 Hamano ..... 446/136
4,037,355 A 7/1977 Street
4,055,913 A 11/1977 Sindelar
4,068,402 A 1/1978 Tanaka
4,091,561 A 5/1978 Kimura
4,094,089 A 6/1978 Sano
4,128,964 A 12/1978 Ogasawara
4,140,276 A 2/1979 Halford
4,146,991 A 4/1979 Sano
4,159,593 A 7/1979 Miller
4,161,279 A 7/1979 Halford
4,185,409 A 1/1980 Cheng
4,195,776 A 4/1980 Lehmann
4,203,247 A 5/1980 Moe et al.
4,219,198 A 8/1980 Meyer et al.
4,223,834 A 9/1980 Fechter
4,241,534 A * 12/1980 Larsson et al. ..... 446/464
4,249,733 A 2/1981 Eddins et al.
4,254,576 A 3/1981 Matsumoto et al.
4,267,661 A 5/1981 Hanson
4,291,488 A 9/1981 Orenstein
4,301,613 A 11/1981 Kooistra, Sr.
4,312,149 A 1/1982 Iwao
4,357,778 A 11/1982 Matsumoto et al.
4,373,693 A 2/1983 Greenberger
4,386,777 A 6/1983 Prehodka
4,394,961 A 7/1983 Muller
4,426,797 A 1/1984 Burkemper et al.
4,468,031 A * 8/1984 Barlow et al. ..... 273/110
4,475,303 A 10/1984 Ribas et al.
4,496,100 A 1/1985 Schwager et al.
4,513,966 A 4/1985 Mucaro et al.
4,519,789 A 5/1985 Halford et al.
4,557,064 A 12/1985 Thompson
4,558,867 A 12/1985 Hippely
4,564,197 A 1/1986 Lambert et al.
4,575,350 A 3/1986 Hippely et al.
RE32,106 E 4/1986 Lamelson
4,585,166 A 4/1986 Stephens
4,609,363 A 9/1986 Udagawa
4,659,320 A 4/1987 Rich et al.
4,673,308 A 6/1987 Reilly
4,678,449 A 7/1987 Udagawa
4,708,685 A 11/1987 Udagawa
4,715,843 A 12/1987 Ostendorff et al.
4,734,076 A 3/1988 Goldstein et al.
4,795,394 A 1/1989 Thompson
4,874,342 A 10/1989 Klitsner
4,909,464 A 3/1990 Levine et al.
4,928,955 A 5/1990 Chuan
4,932,917 A 6/1990 Klitsner
4,951,872 A 8/1990 Sheffield
4,961,716 A 10/1990 Hippely et al.
5,022,884 A 6/1991 Hippely et al.
5,075,515 A 12/1991 Yoneda et al.
5,078,642 A 1/1992 Glessner
5,102,133 A 4/1992 Chilton et al.
5,107,601 A 4/1992 Semchuck
5,161,104 A 11/1992 Fox et al.
5,174,569 A 12/1992 Ngai
5,254,030 A * 10/1993 Ostendorff et al. ..... 446/430
5,299,969 A 4/1994 Zaruba
5,312,285 A 5/1994 Rieber et al.
5,342,048 A 8/1994 Jones et al.
5,344,143 A 9/1994 Yule
5,370,571 A 12/1994 Bosch
5,392,987 A 2/1995 Ropers et al.
5,419,066 A 5/1995 Harnois et al.
5,473,833 A 12/1995 Ostrovsky

(56) References Cited

U.S. PATENT DOCUMENTS

| | | | | |
|---|---|---|---|---|
| 5,480,115 | A | 1/1996 | Haltof | |
| 5,542,668 | A | 8/1996 | Casale et al. | |
| 5,586,923 | A | 12/1996 | Hippely et al. | |
| 5,735,724 | A | 4/1998 | Udagawa | |
| 5,767,655 | A | 6/1998 | Ostendorff et al. | |
| 5,785,573 | A | 7/1998 | Rothbarth et al. | |
| 5,803,782 | A | 9/1998 | Selton | |
| 5,846,018 | A | 12/1998 | Frobosilo et al. | |
| 5,855,501 | A | 1/1999 | Kato et al. | |
| 5,899,011 | A | 5/1999 | Brinkman | |
| 5,899,789 | A | 5/1999 | Rehkemper et al. | |
| 5,967,052 | A | 10/1999 | Prokopf | |
| 6,000,992 | A | 12/1999 | Lambert | |
| 6,026,603 | A | 2/2000 | Kump et al. | |
| 6,056,620 | A | 5/2000 | Tobin | |
| 6,170,754 | B1 | 1/2001 | Halford | |
| 6,241,573 | B1 | 6/2001 | Ostendorff et al. | |
| 6,358,112 | B1 | 3/2002 | Lambert et al. | |
| 6,409,132 | B2 | 6/2002 | Heisler et al. | |
| 6,439,955 | B1 | 8/2002 | Feketo | |
| 6,478,654 | B1 | 11/2002 | Rehkemper et al. | |
| 6,508,179 | B2 | 1/2003 | Annis et al. | |
| 6,640,453 | B2 | 11/2003 | Eisenmenger | |
| 6,647,893 | B1 | 11/2003 | Fugitt et al. | |
| 6,676,480 | B2 | 1/2004 | Sheltman | |
| 6,766,585 | B2 | 7/2004 | Thomas | |
| 6,783,419 | B1 | 8/2004 | Paukert et al. | |
| 6,862,997 | B2 | 3/2005 | Bussink | |
| 6,951,307 | B2 | 10/2005 | Lin | |
| 6,951,497 | B1 | 10/2005 | Ngan | |
| 6,951,498 | B2 | 10/2005 | Rudell | |
| 6,953,377 | B2 | 10/2005 | Quercetti | |
| D511,961 | S | 11/2005 | Jordan | |
| 6,976,316 | B1 | 12/2005 | Patterson | |
| 7,066,783 | B2 | 6/2006 | Fischer | |
| 7,325,348 | B2 | 2/2008 | Mueller et al. | |
| 7,353,758 | B2 | 4/2008 | Murray | |
| 7,373,731 | B2 | 5/2008 | Nyberg | |
| 7,517,272 | B2 * | 4/2009 | Bedford et al. | 446/444 |
| 7,527,156 | B2 | 5/2009 | Wisnoski et al. | |
| 7,549,906 | B2 | 6/2009 | Bedford et al. | |
| 7,600,757 | B1 | 10/2009 | Matilla et al. | |
| 7,600,859 | B2 * | 10/2009 | Huang et al. | 347/63 |
| 7,614,931 | B2 * | 11/2009 | Nuttall | 446/444 |
| 7,618,302 | B2 | 11/2009 | Collins et al. | |
| 7,628,673 | B2 | 12/2009 | Bedford et al. | |
| 7,651,398 | B2 | 1/2010 | Ostendorff et al. | |
| 7,690,964 | B2 | 4/2010 | Nuttall et al. | |
| 7,708,317 | B2 | 5/2010 | Leblanc | |
| 7,766,720 | B2 | 8/2010 | Ostendorff | |
| 7,770,811 | B2 | 8/2010 | Belding | |
| 7,857,679 | B2 | 12/2010 | O'Connor et al. | |
| 8,162,716 | B2 | 4/2012 | Nuttall | |
| 8,430,712 | B2 * | 4/2013 | O'Connor et al. | 446/444 |
| 8,608,527 | B2 * | 12/2013 | O'Connor et al. | 446/444 |
| 8,690,462 | B2 * | 4/2014 | Shaw et al. | 400/283 |
| 8,690,632 | B2 * | 4/2014 | O'Connor et al. | 446/444 |
| 8,747,180 | B2 * | 6/2014 | O'Connor et al. | 446/444 |
| 8,814,628 | B2 * | 8/2014 | O'Connor et al. | 446/444 |
| 2003/0220044 | A1 | 11/2003 | Andrews et al. | |
| 2003/0224697 | A1 | 12/2003 | Sheltman et al. | |
| 2004/0078991 | A1 | 4/2004 | Thomas | |
| 2005/0287915 | A1 | 12/2005 | Sheltman et al. | |
| 2005/0287919 | A1 | 12/2005 | Sheltman et al. | |
| 2006/0027779 | A1 | 2/2006 | McGuire | |
| 2006/0277779 | A1 | 12/2006 | Bauer | |
| 2006/0286896 | A1 | 12/2006 | Bedford et al. | |
| 2006/0286897 | A1 * | 12/2006 | Bedford et al. | 446/444 |
| 2007/0012636 | A1 | 1/2007 | Wisnoski et al. | |
| 2007/0049160 | A1 | 3/2007 | Matthes et al. | |
| 2007/0128969 | A1 * | 6/2007 | Shrock et al. | 446/153 |
| 2007/0209543 | A1 | 9/2007 | Beaulieu et al. | |
| 2008/0064295 | A1 | 3/2008 | Abrams | |
| 2008/0066560 | A1 | 3/2008 | Yu et al. | |
| 2008/0070474 | A1 * | 3/2008 | Nuttall | 446/444 |
| 2008/0268743 | A1 | 10/2008 | O'Connor et al. | |
| 2009/0075558 | A1 | 3/2009 | Ostendorff | |
| 2010/0056015 | A1 | 3/2010 | Nuttall | |
| 2010/0112896 | A1 | 5/2010 | Chang et al. | |
| 2010/0184353 | A1 | 7/2010 | Jobe | |
| 2010/0199598 | A1 | 8/2010 | Townsend et al. | |
| 2010/0273394 | A1 | 10/2010 | O'Connor et al. | |
| 2010/0304639 | A1 | 12/2010 | Payne et al. | |
| 2011/0086574 | A1 | 4/2011 | Nuttall et al. | |
| 2011/0124265 | A1 | 5/2011 | O'Connor et al. | |
| 2011/0269372 | A1 | 11/2011 | Nuttall | |
| 2012/0052766 | A1 | 3/2012 | Payne | |
| 2012/0052767 | A1 | 3/2012 | Martino et al. | |
| 2012/0061484 | A1 * | 3/2012 | Payne et al. | 238/10 A |
| 2012/0062766 | A1 * | 3/2012 | Park | 348/231.5 |
| 2012/0115393 | A1 * | 5/2012 | Moh et al. | 446/429 |
| 2012/0164914 | A1 | 6/2012 | O'Connor et al. | |
| 2012/0276808 | A1 | 11/2012 | Nuttall et al. | |
| 2012/0322342 | A1 | 12/2012 | De La Torre | |
| 2013/0288568 | A1 | 10/2013 | Schmid et al. | |
| 2014/0070015 | A1 * | 3/2014 | Matthes et al. | 238/10 A |
| 2014/0183272 | A1 * | 7/2014 | O'Connor et al. | 238/10 A |

FOREIGN PATENT DOCUMENTS

| | | | |
|---|---|---|---|
| DE | 440375 | C | 2/1927 |
| DE | 575170 | C | 4/1933 |
| DE | 4403361 | A1 | 8/1995 |
| GB | 2043469 | A | 2/1927 |
| GB | 2043469 | A | 10/1980 |
| JP | 07-328241 | A | 12/1995 |
| WO | 88-04191 | A1 | 6/1988 |
| WO | 2011137433 | A2 | 3/2011 |
| WO | 2012027737 | A2 | 1/2012 |
| WO | 2012027753 | A2 | 1/2012 |
| WO | 2012027737 | A3 | 3/2012 |
| WO | 2012027753 | A2 | 3/2012 |
| WO | 2012027753 | A3 | 3/2012 |

OTHER PUBLICATIONS

European Search Report dated Nov. 5, 2013 for Application No. 13184129.8.

Partial European Search Report for Application No. 13187427.3-1658; Dated: Feb. 5, 2014.

International Search Report dated Apr. 9, 2012 for International Application No. PCT/US2011/049587.

Written Opinion dated Apr. 9, 2012 for International Application No. PCT/US2011/049587.

English Translation of Abstract CN201067632.

English Translation of Abstract CN101687116.

English Translation of Chinese Office Action for Application No. 2013101901814 dated Feb. 3, 2015.

Chinese Office Action for Application No. 2013101901814 dated Feb. 3, 2015.

* cited by examiner

TOY TRACK SET

CROSS-REFERENCE TO RELATED APPLICATIONS

The present application is a nonprovisional application of and claims the benefit of U.S. Provisional Patent Application Ser. No. 61/639,437 filed on Apr. 27, 2012, the contents of which are incorporated herein by reference.

BACKGROUND

Various embodiments of the present invention are related to toys in particular, a track set for toy vehicles to travel on.

Toy vehicle track sets have been popular for many years and generally include one or more track sections arranged to form a path around which one or more toy vehicles can travel. Toy vehicles which may be used on such track sets may be either self-powered vehicles or may receive power from an external source.

Accordingly, it is desirable to provide toy track set with features that provide unique paths for the toy vehicles of the toy track to travel on.

SUMMARY OF THE INVENTION

In one embodiment, a track set is provided. The track set includes a first track segment having a first pivot, the first track segment rotatable about the first pivot from a first position to a second position. A carriage is rotationally coupled to an end of the first track segment by a second pivot, the carriage configured to rotate about the second pivot as the first track segment rotates from the first position to the second position.

In another embodiment, a track set is provided having a base. A first track segment is rotationally coupled to the base by a first pivot, the first track segment being movable between a first position and a second position. A carriage is rotationally coupled to the first track segment by a second pivot, wherein the carriage is configured to rotate about the second pivot when the first track segment moves from the first position to the second position.

In accordance with another embodiment, a track set is provided having a release device and a base. A rotating arm assembly is rotationally coupled to the base, the rotating arm assembly having a first track segment having a first end and a second end. The first end is removably coupled to the release device, the first track segment being rotatable about a first pivot between a first position and a second position, the rotating arm assembly further having a carriage rotationally coupled about a second pivot to the second end, wherein the rotating arm assembly has a center of gravity on a side of the first pivot opposite the carriage. A second track segment is spaced apart from the first track segment, wherein the carriage is adjacent the second track segment in the second position.

DETAILED DESCRIPTION

Figure 1:
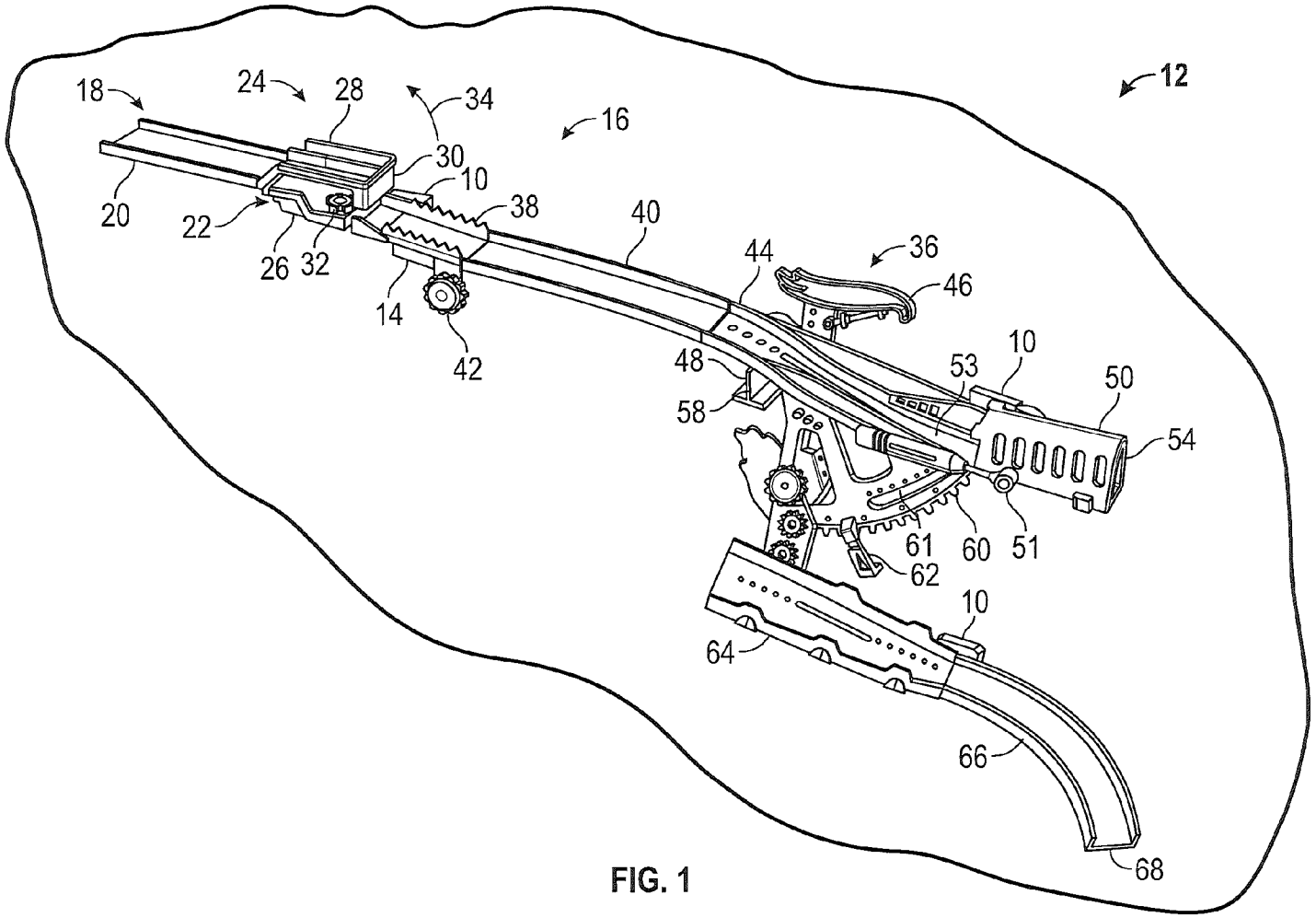
FIG. 1 is a perspective view of a track set in accordance with an embodiment of the invention.

Referring now to FIGS. 1-8, a track set 12 in accordance with an exemplary embodiment of the present invention is illustrated. In one embodiment, the track set 12 may be mounted to a wall. The wall mount 10 has a planar member 14 that is secured to a wall 16 via removable double-sided adhesive tape or other equivalent fastening arrangement. One non-limiting example of such adhesive tape it is commercially available from 3M sold under the trademark COMMAND STRIP. In one embodiment, the wall mount 10 may be that described in commonly owned U.S. patent application Ser. No. 13/220,364 filed on Aug. 29, 2011, and U.S. Provisional Patent Application Ser. Nos. 61/377,743 and filed on Aug. 27, 2010 and 61/480,793 filed on Apr. 29, 2011, the contents each of which are incorporated herein by reference in their entirety. It should be appreciated that while embodiments of this invention illustrate the track set 12 mounted to a wall, the claimed invention should not be so limited, in other embodiments the track set 12 may include support stands that allow the track set 12 to be a free standing track set that rests on a play surface.

The track set 12 includes a track section 18 having a first track segment 20, a release device 22, and an exit track segment 24 positioned in a serial arrangement. The release device 22 includes a body 26 with a holder member 28 coupled thereto. In one embodiment, the holder member 28 is biased to rotate an end 30 away from the body 26 as indicated by arrow 34 in response to the user actuating a lever 32. The rotation of the end 30 allows a toy vehicle to exit the release device 22 onto the exit track segment 24 under the influence of gravity. In other embodiments, the release device 22 may include a stored energy mechanism, such as a spring, that imparts a force on the toy vehicle to propel the toy vehicle into the exit track segment 24.

Referring to FIG. 1, adjacent the exit track segment 24 is a rotating arm assembly 36. The rotating arm assembly 36 includes a ramp 38 that engages an end of the exit track segment 24. The ramp 38 directs the toy vehicle onto a second track segment 40. The end of the second track segment 40 is arranged offset from the end of the exit track segment 24 to allow the rotating arm assembly 36 to rotate freely without interference from the release device 22. A feature 42 may be coupled to the ramp 38 or the second track segment 40. In one embodiment, the feature 42 may be a counter weight that biases the rotating arm assembly 36 such that the rotating arm assembly 36 is biased to rotate in a manner that allows the ramp 38 to engage exit track segment 24 when there are no toy vehicles on the rotating arm assembly 36.

As shown in FIG. 1, adjacent the second track segment 40 is a third track segment 44 that is coupled to a base 46 by a pivot 48. On an opposite end of the third track segment 44 is a carriage portion 50. As will be discussed in more detail below, the carriage portion 50 is rotationally coupled to the third track segment 44 by a pivot 51. In one non-limiting embodiment, the first pivot 48 and the second pivot 51 have axes that are substantially parallel. In another non-limiting embodiment, the pivots 48, 51 have non-parallel axes. The carriage portion 50 has an opening 52 (see FIG. 4) arranged to receive a toy vehicle from the third track segment 44 and a closed end 54 (see FIG. 1) such that the toy vehicle may enter and exit the carriage portion through the opening 52. In the exemplary embodiment, the carriage portion 50 is sized to contain/capture and at least partially encapsulate the toy vehicle during transportation. It should be appreciated that the carriage portion 50 may have a plurality of openings therein for aesthetic purposes and to enhance imaginary play. The carriage portion 50 further has a gear member 56 (shown schematically in FIG. 9) that causes the carriage portion 50 to rotate about the pivot 51 in response to the rotation of the third track segment 44 about the pivot 48. In one non-limiting embodiment, the carriage portion 50 has a track projection 53 that engages the third track segment 44.

The base 46 is a generally planar member having a first projection 58 that supports the pivot 48 and the third track segment 44. On a distal end from the pivot 48, the base member 46 further includes a plurality of gear teeth 60 that are arranged along an arc centered on the pivot 48. The gear teeth 60 are positioned to engage the gear member 56. The base 46 may also include a curved slot 61 adjacent the gear teeth 60. The slot 61 may receive a pin (not shown) on the third track segment 44 that supports and guides the track segment during rotation. The base 46 further includes a stop member 62 adjacent the end of the gear teeth 60. In the exemplary embodiment, the stop member 62 extends generally perpendicular to the plane of the base 46 and is arranged to contact and stop the rotation of the carriage portion 50 during operation.

Figure 2:
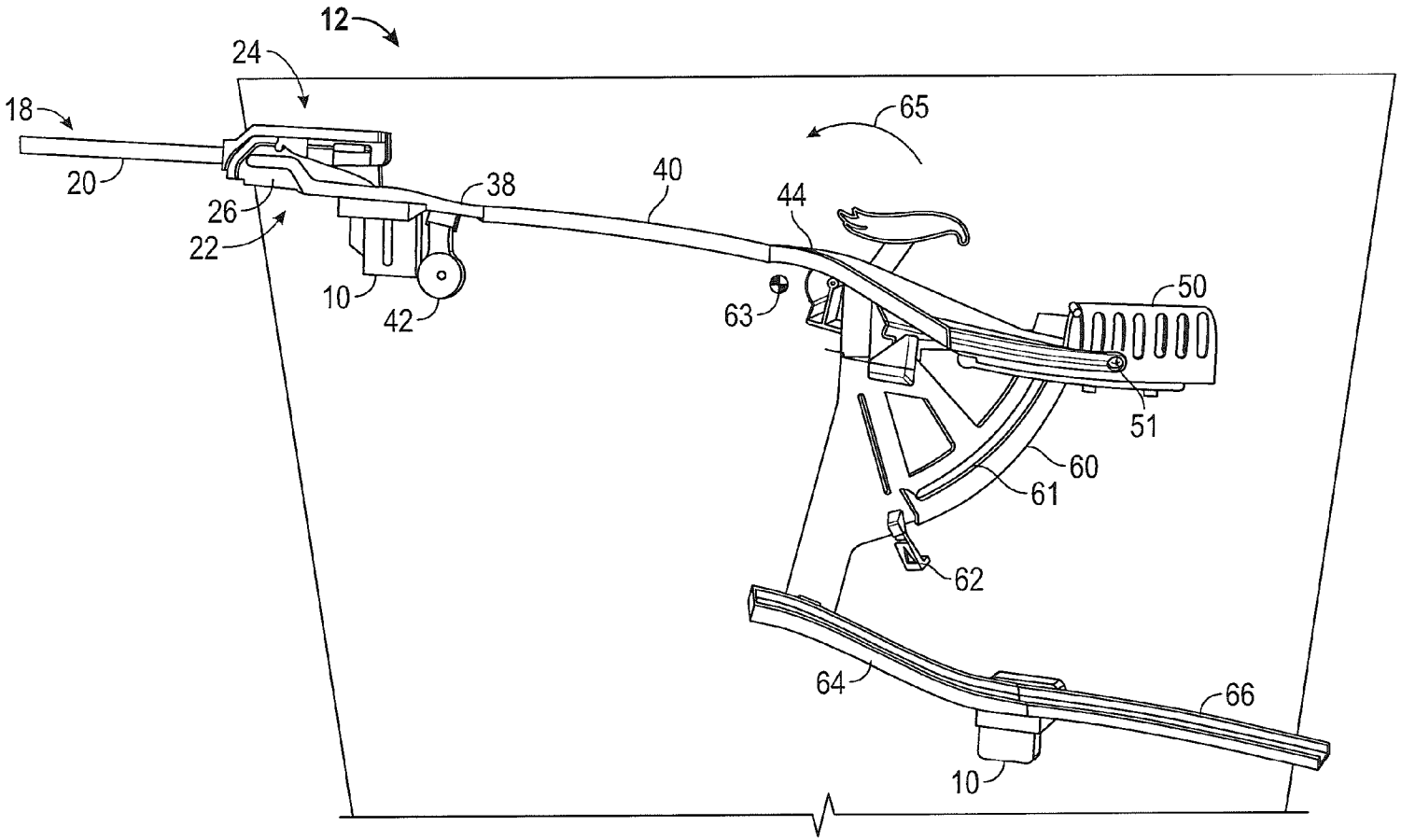
FIG. 2 is a front view of the track set of FIG. 1.
Figure 3:
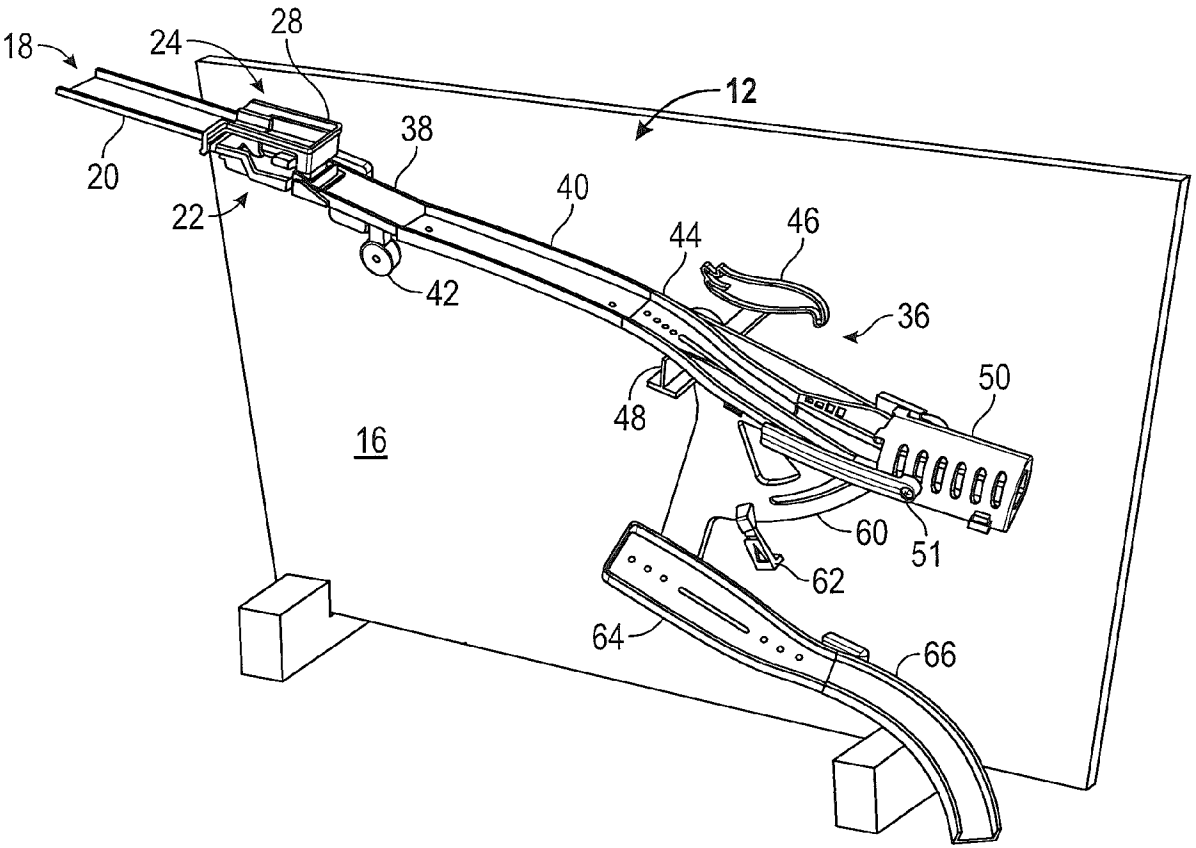
FIG. 3 is another perspective view of the track set of FIG. 1.
Figure 4:
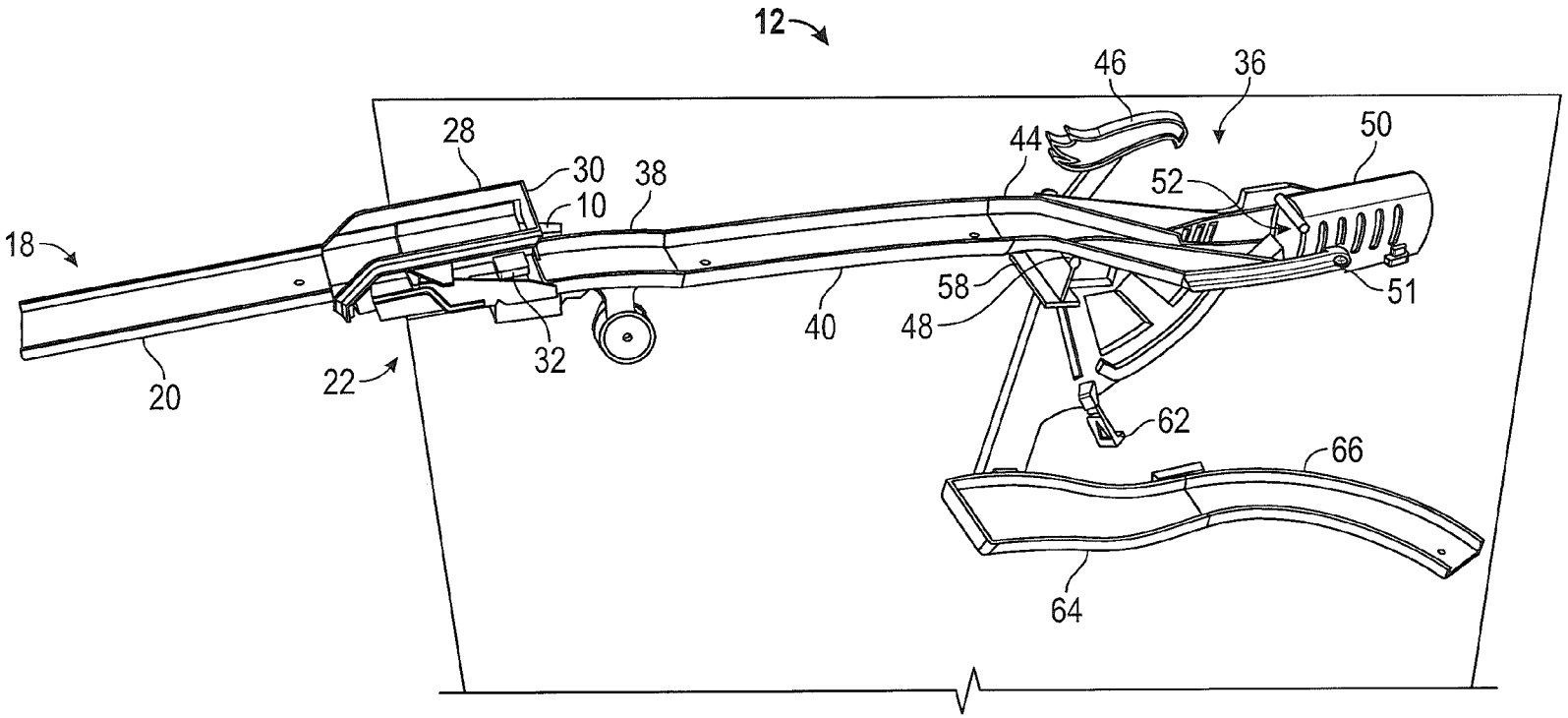
FIG. 4 is a reverse perspective view of the track set of FIG. 1.
Figure 5:
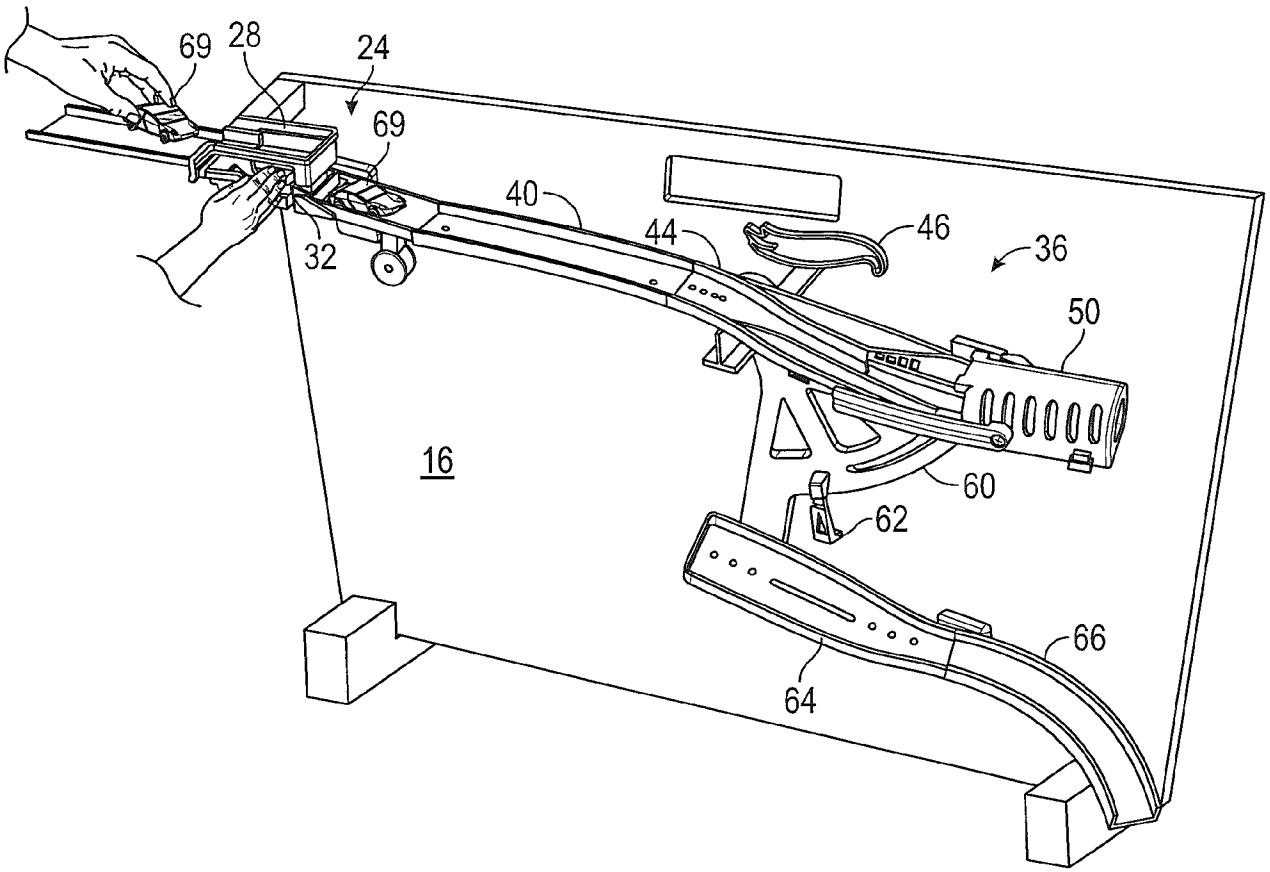
FIG. 5 is a perspective view of the track set of FIG. 1 in a first position.
Figure 6:
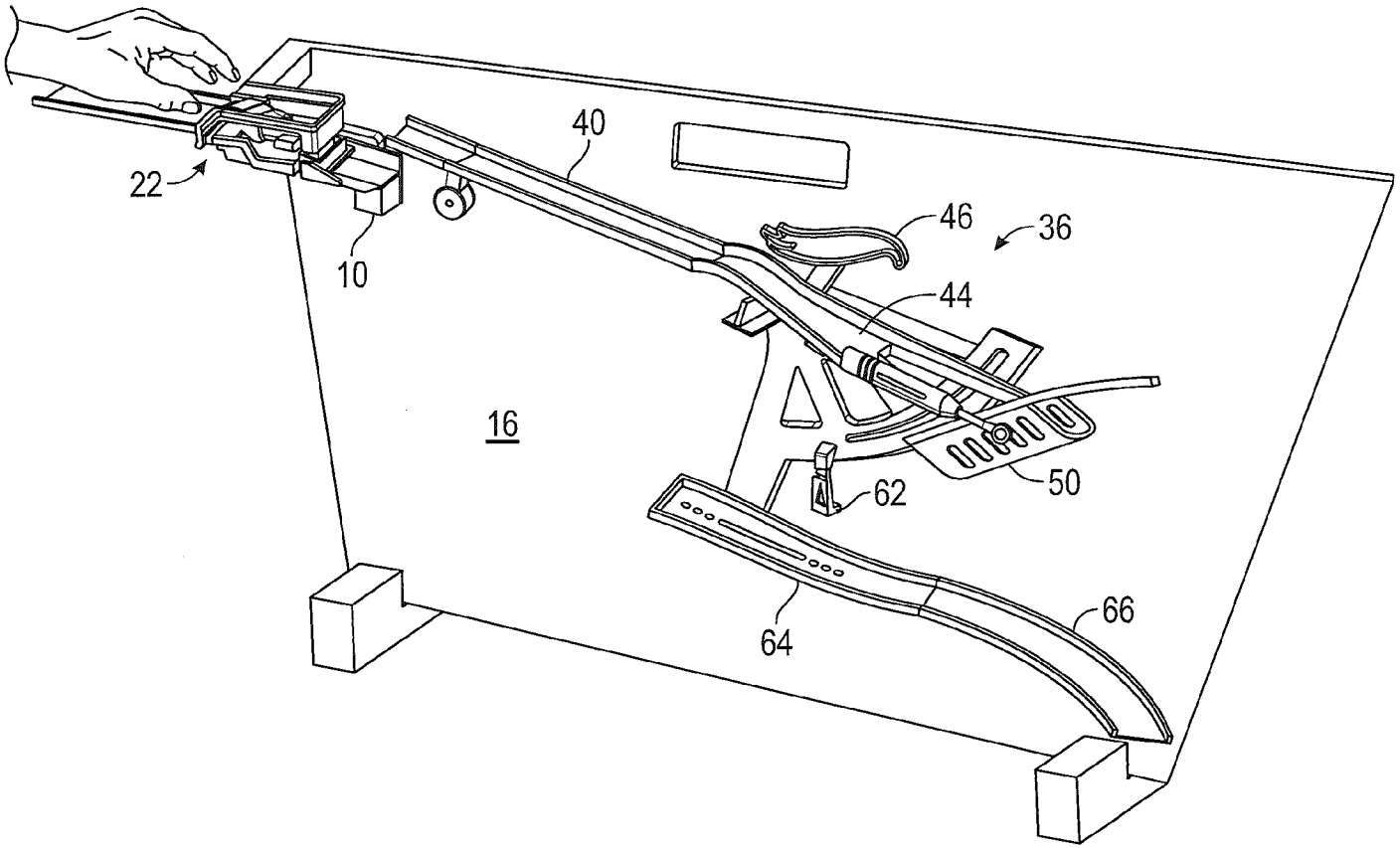
FIG. 6 is a perspective view of the track set of FIG. 1 transitioning from the first position to a second position.

The rotating arm assembly 36 is arranged such that the center of gravity 63 (see FIG. 2) of the rotating portions of the assembly 38, 40, 44, 50 is located in a position offset to the left of the pivot 48 when viewed from the front as shown in FIG. 2. In other words, the center of gravity 63 is on the side of the pivot 48 closest to the second track segment 40. As a result, the rotating arm assembly 36 is biased to rotate in the direction indicated by arrow 65 (see FIG. 2) when there is no toy vehicle on the rotating arm assembly 36. In another embodiment, the rotating arm assembly 36 may be biased towards the exit ramp portion 38 by an elastic member, such as a spring for example.

Coupled to the base 46 adjacent the stop member 62 is a fourth track segment 64. The third track segment 44 and the fourth track segment 64 are offset such that they are separated by a gap. This gap is traversed by the rotating arm assembly 36. As such, the fourth track segment 64 is arranged to receive the toy vehicle from the carriage portion 50 when the carriage portion 50 is in contact with the stop member 62. In the exemplary embodiment, the fourth track segment 64 is angled downward to allow a toy vehicle received from the carriage portion 50 to move under the influence of gravity. A fifth track segment 66 may be coupled to the fourth track segment 64 to receive a toy vehicle. In the exemplary embodiment, the end 68 of the fifth track segment is open to allow the toy vehicle 69 to exit the track set 12. It should be appreciated that the fifth track segment may be configured to couple with one or more additional track segments (not shown) to further enhance play.

During operation, the user inserts one or more toy vehicles 69 (FIG. 5) on the first track segment 20 and the release device 22. It should be appreciated that the first track segment 20 may be angled to allow the toy vehicles to enter the release device 22 when the toy vehicle is released. After the toy vehicle 69 exits the release device 22, it travels along the ramp 38 onto the second track segment 40. The second track segment 40 guides the toy vehicle into the third track segment 44 and into the carriage portion 50. As the toy vehicle 69 passes the pivot 48, the additional weight of the toy vehicle will cause the center of gravity 63 to move towards the pivot 48. As the toy vehicle 69 proceeds along the third track segment 44 and into the carriage portion 50, the center of gravity will move further to the right of the pivot 48 (e.g. the side opposite the second track segment 40). It should be appreciated that this movement of the center of gravity biases the rotating arm assembly 36 to rotate in the direction opposite arrow 65. When the toy vehicle is positioned with in the carriage portion 50, the shift in the center of gravity is sufficient to move the rotating arm assembly 36 from a first position (FIG. 5) with the ramp 38 engaging the exit track segment 24 to a second position (FIG. 7) with the ramp 38 distal from the exist track segment 24.

Figure 7:
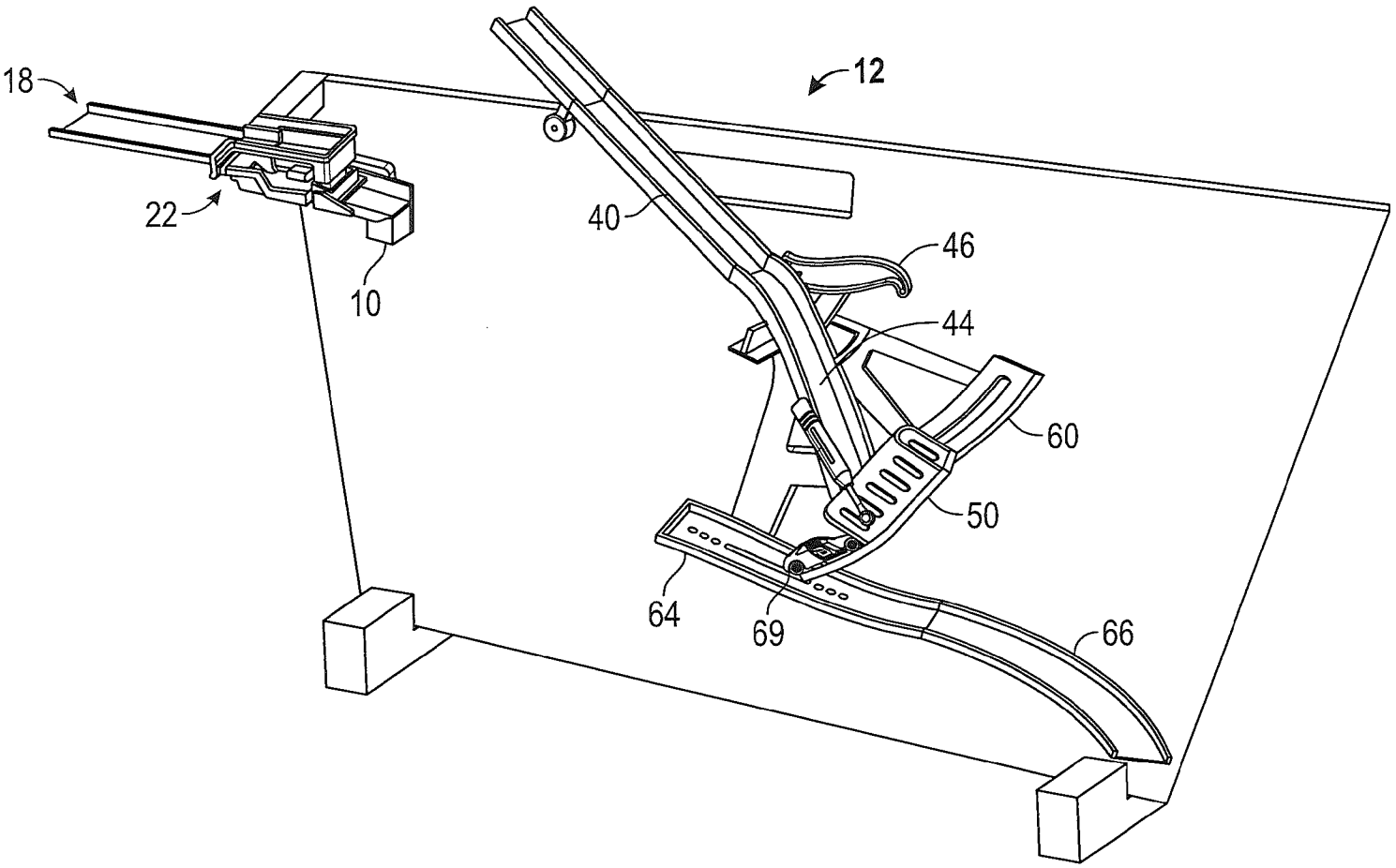
FIG. 7 is a perspective view of the track set of FIG. 1 transitioning from the first position to a second position.
Figure 8:
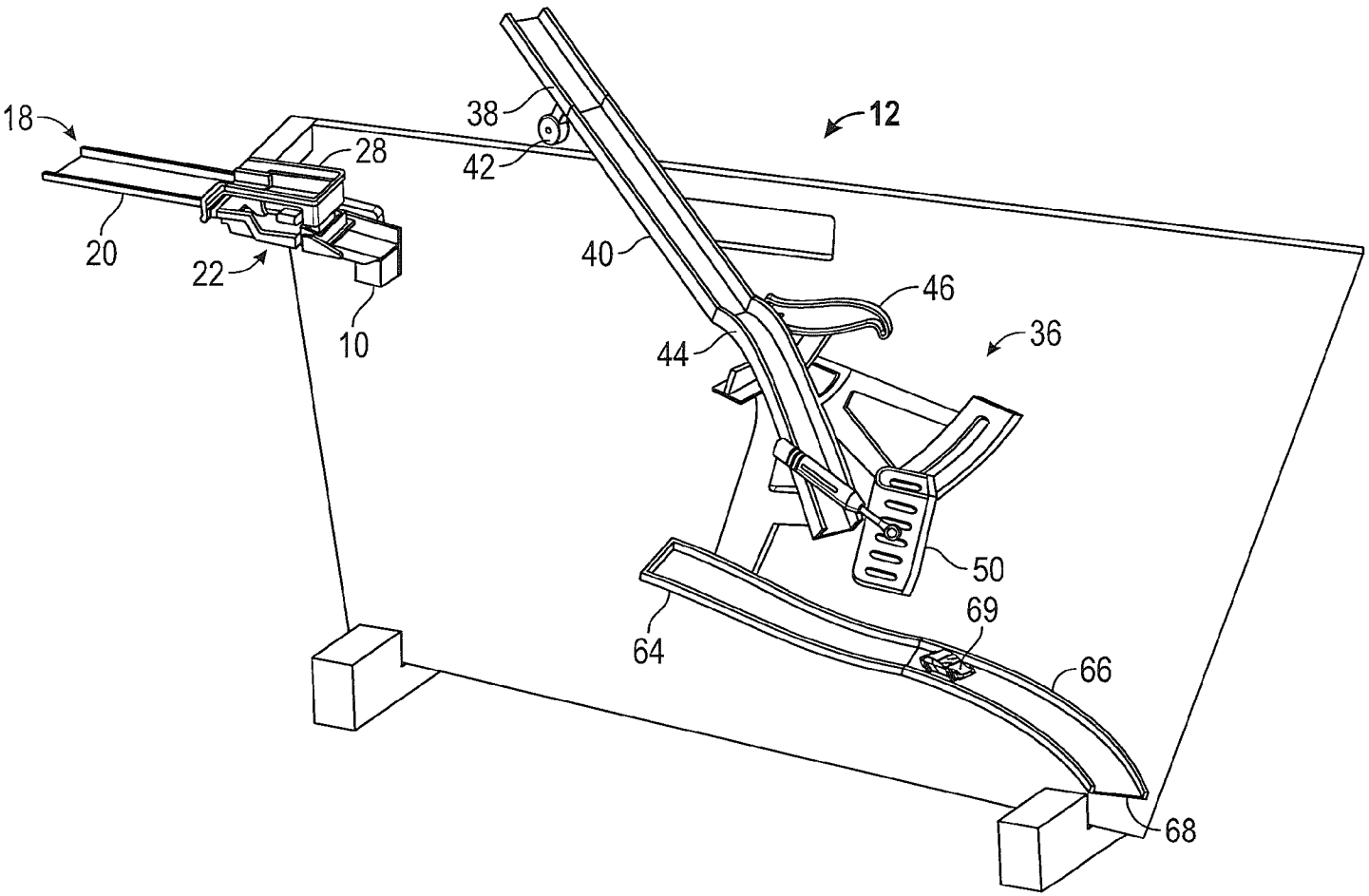
FIG. 8 is a perspective view of the track set of FIG. 1 in the second position.
Figure 9:
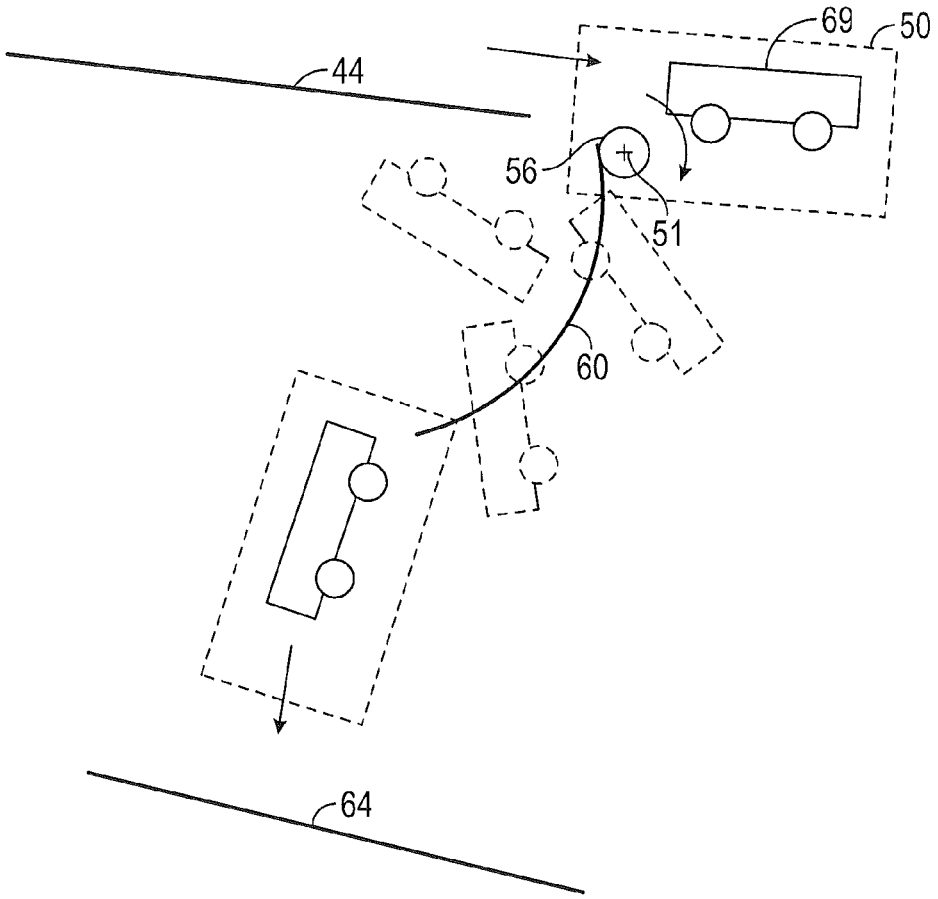
FIG. 9 is a schematic illustration of the rotation of a toy vehicle in the rotational arm assembly transiting from the first position to the second position.

As the rotating arm assembly 36 rotates from the first position to the second position, the carriage portion 50 will move in an arcuate path with the gear member 56 engaging the gear teeth 60. This engagement causes the carriage portion 50 to rotate about the pivot 51 (FIG. 9). Thus, the carriage portion 50 and the toy vehicle 69 are rotating about two axes simultaneously. In one embodiment, the carriage portion rotates about 700 degrees about the pivot 51 between the first position and the second position. When in the second position, the carriage portion 50 contacts the stop member 62 to prevent further rotation of the rotating arm assembly 36. In the exemplary embodiment, the carriage portion 50 rotates about 700 degrees such that the opening 52 is opposite the fourth track segment 64 when in the second position. Due to the sudden stop of the rotating arm assembly and the orientation of the carriage portion 50, when the rotating arm assembly reaches the second position, the toy vehicle exits the carriage portion 50 along the track projection 53 and onto the fourth track segment 64 (FIG. 7).

Once the toy vehicle 69 is transferred to the fourth track segment 64, the center of gravity 63 reverts to its original position causing the rotating arm assembly 36 to be biased in the direction of arrow 65. Thus the rotating arm assembly 36 will rotate from the second position back to the first position. As the rotating arm assembly 36 moves to the first position, the fourth track segment 64 is then cleared and the toy vehicle 69 may proceed under the influence of gravity along the fourth track segment 64 and the fifth track segment 66.

In other embodiments, the rotating arm assembly apparatus may be configured to traverse another axis, or combination of axes, while employing the momentum of the vehicle to actuate the swinging motion.

Figure 10:
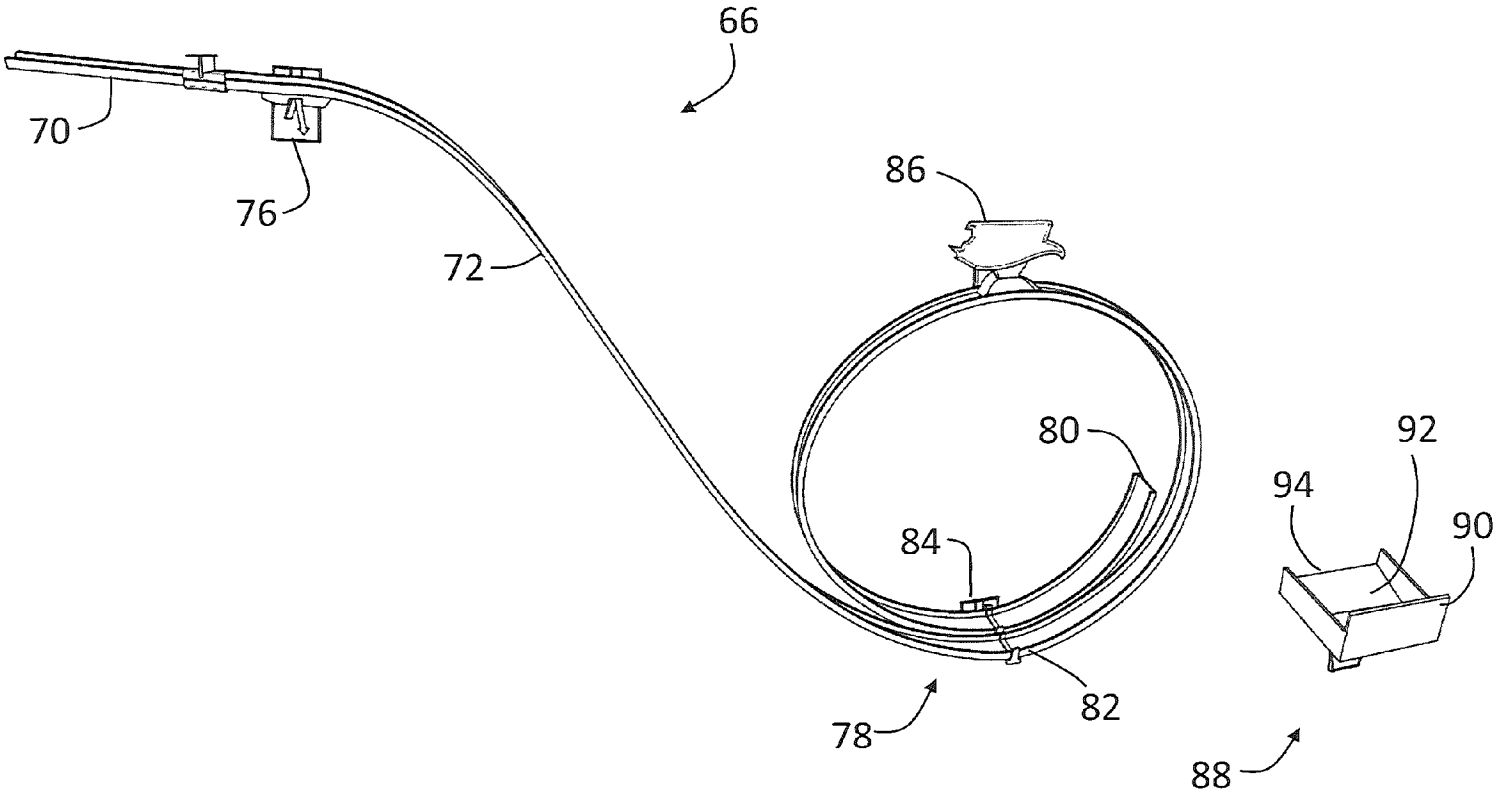
FIG. 10 is a perspective view of an exit track segment including a loop section.

Referring now to FIG. 10, another embodiment is shown of the fifth track segment 66. In this non-limiting embodiment, the track segment 66 includes a first track segment 70 that couples with track segment 64. On one end, the first track segment 70 is coupled to a second track segment 72 that extends downward toward the floor of the play area. The second track segment 72 may be coupled to a surface, such as a wall for example, by a bracket 76. The bracket 76 may be mounted to the wall by a removable double-sided adhesive tape or other equivalent fastening arrangement. One non-limiting example of such adhesive tape it is commercially available from 3M sold under the trademark COMMAND STRIP. In one embodiment, the bracket 76 may be that described in the aforementioned commonly owned U.S. patent Ser. No. 13/220,364 filed on Aug. 29, 2011, and U.S. Provisional Patent Application Ser. Nos. 61/377,743 and filed on Aug. 27, 2010 and 61/480,793 filed on Apr. 29, 2011. It should be appreciated that in one non-limiting embodiment, the first track segment 70 and the second track segment 72 may be formed from a single continuous track member.

The second track segment 72 extends downward into a third track segment 78. In the exemplary embodiment, the third track segment is formed into a spiral or helix shaped loop that extends about 380° to 450°. In one non-limiting embodiment, the termination end 80 of the third track segment is located approximately 405° from the entry location 82 of the looped track segment 78. A holder member 84 may be positioned at or adjacent the entry location 82 to maintain the track in the desired shape. A mounting bracket 86 may be coupled to the apex of the looped and third track segment 78. Similar to the bracket 76, the mounting bracket 86 may include an adhesive tape to allow the mounting bracket 86 to be removably coupled to a wall.

In the exemplary embodiment, the termination end 80 is positioned and oriented to allow a toy vehicle traveling on the track segment 66 to fly through the air and land in a basket member 88. In one embodiment, the basket member 88 is mounted on a wall. The basket member 88 includes a plurality of sides 90 that define an area sized to receive the toy vehicles that exit from termination end 80. In one non-limiting embodiment, the basket 88 includes a bottom surface 92 that includes a hinge on one end 94. The bottom surface 92 is biased, such as with a spring (not shown) for example into engagement with the sides 90. The biasing mechanism is configured such that when a predetermined number of toy vehicles are positioned in the basket 88, the surface 92 rotates to an open or lowered position which allows the toy vehicles to exit the basket 88, such as onto the play surface for example.

It should be appreciated that the track segment 66 may be used with the track set 12, as described above. However, the claimed invention should not be so limited and the track segment 66 may be used as a stand-alone play set with the user placing the toy vehicles in the first track segment 70.

In accordance with an exemplary embodiment and as with all of the aforementioned track sets each track disclosed herein set can be mounted as a stand-alone set or be combined with other wall mounted track sets.

In the preceding detailed description, numerous specific details are set forth in order to provide a thorough understanding of various embodiments of the present invention. However, those skilled in the art will understand that embodiments of the present invention may be practiced without these specific details, that the present invention is not limited to the depicted embodiments, and that the present invention may be practiced in a variety of alternative embodiments. Moreover, repeated usage of the phrase "in an embodiment" does not necessarily refer to the same embodiment, although it may. Lastly, the terms "comprising," "including," "having," and the like, as used in the present application, are intended to be synonymous unless otherwise indicated. This written description uses examples to disclose the invention, including the best mode, and to enable any person skilled in the art to practice the invention, including making and using any devices or systems. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A track set, comprising:

a first track segment having a first end and a second end, the first track segment being pivotally mounted to the track set for movement about a first pivot, wherein the first track segment is rotatable about the first pivot from a first position to a second position and wherein the first end is elevated and the second end is lowered as the first track segment rotates from the first position to the second position;

a carriage coupled to the first track segment proximate to the second end, wherein the carriage is rotationally mounted to a second pivot, and wherein the carriage rotates about the second pivot as the first track segment rotates from the first position to the second position; and wherein a gear of the carriage engages a plurality of gear teeth in order to rotate the carriage as the first track segment rotates from the first position to the second position.

2. The track set of claim 1 wherein the carriage rotates about 700 degrees about the second pivot as the first track segment rotates from the first position to the second position.

3. The track set of claim 1 wherein the first track segment is configured to rotate from the first position to the second position in response to a toy vehicle entering the carriage.

4. The track set of claim 3 wherein the first track segment is configured to rotate from the second position to the first position in response to the toy vehicle exiting the carriage.

5. The track set of claim 1, wherein the track set further comprises a stop member positioned to stop rotational movement of the carriage when the first track segment is in the second position.

6. The track set of claim 1 wherein the first pivot is coupled to a wall.

7. The track set as in claim 1, wherein the first track segment and the plurality of teeth are mounted to a wall.

8. The track set as in claim 1, wherein the plurality of gear teeth are arranged in an arcuate path.

9. The track set as in claim 1, wherein the first track segment and the carriage comprise an assembly rotationally mounted to the first pivot, wherein the assembly has a center of gravity on a side of the first pivot that is opposite of the carriage.

10. A track set comprising:

a base;

a first track segment rotationally coupled to the base by a first pivot, wherein the first track segment rotates between a first position and a second position with respect to the base and wherein a first end of the first track segment is elevated and a second end of the first track segment is lowered as the first track segment moves from the first position to the second position;

a carriage rotationally coupled to a second pivot proximate to the second end of the first track segment, wherein the second pivot is offset from the first pivot, and wherein the carriage rotates about the second pivot as the first track segment moves from the first position to the second position, wherein the carriage is configured to receive and retain a toy vehicle therein; and a second track segment located below the first track segment and separated from the first track segment by a gap, wherein the toy vehicle is transferred from the first track segment to the second track segment by rotational movement of both the first track segment and the carriage.

11. The track set of claim 10 wherein the base includes a plurality of gear teeth configured to engage a gear of the carriage as the first track segment moves from the first position to the second position and wherein the engagement of the plurality of gear teeth with the gear causes the rotational movement of the carriage about the second pivot.

12. The track set of claim 11, wherein the base further comprises a stop member adjacent one end of the plurality of gear teeth the stop member configured to prevent rotational movement of the carriage about the second pivot.

13. The track set of claim 11, wherein the first track segment and the carriage are configured to move about the first pivot when the toy vehicle enters into the carriage.

14. The track set as in claim 11, wherein the plurality of gear teeth are arranged in an arcuate path.

15. The track set of claim 10, wherein the base member is mounted to a wall.

16. The track set of claim 10 wherein the carriage rotates about 700 degrees as the first track segment moves from the first position to the second position.

17. The track set as in claim 10, wherein the base is mounted to a wall.

18. The track set as in claim 10, wherein the first track segment and the carriage comprise an assembly rotationally mounted to the base about the first pivot, wherein the assembly has a center of gravity on a first side of the first pivot opposite the carriage.

19. The track set as in claim 10, wherein the first track segment returns to the first position upon transference of the toy vehicle from the carriage to the second track segment.

20. The track set as in claim 19, wherein the plurality of gear teeth are arranged in an arcuate path.

* * * * *